United States Patent [19]

Dunn et al.

[11] Patent Number: 4,959,194

[45] Date of Patent: Sep. 25, 1990

[54] HIGH STRENGTH URANIUM-TUNGSTEN ALLOY PROCESS

[75] Inventors: Paul S. Dunn, Santa Fe; Haskell Sheinberg; Billy M. Hogan, both of Los Alamos, all of N. Mex.; Homer D. Lewis, Bayfield, Colo.; James M. Dickinson, Los Alamos, N. Mex.

[73] Assignee: The United States of America as represented by the United States Department of Energy, Washington, D.C.

[21] Appl. No.: 329,901

[22] Filed: Mar. 28, 1989

[51] Int. Cl.[5] ..... B22F 7/00

[52] U.S. Cl. ..... 419/46; 420/3; 420/590

[58] Field of Search ..... 420/3, 590; 419/46

[56] References Cited

U.S. PATENT DOCUMENTS 3,285,737 11/1966 Bellamy ..... 420/3

OTHER PUBLICATIONS

Phase Diagrams of Uranium Alloys, pp. 62 et seq., 1983.

*Primary Examiner*—Stephen J. Lechert, Jr.

*Attorney, Agent, or Firm*—Richard J. Cordovano; Paul D. Gaetjens; William R. Moser

[57] ABSTRACT

Alloys of uranium and tungsten and a method for making the alloys. The amount of tungsten present in the alloys is from about 4 wt % to about 35 wt %. Tungsten particles are dispersed throughout the uranium and a small amount of tungsten is dissolved in the uranium.

15 Claims, No Drawings

HIGH STRENGTH URANIUM-TUNGSTEN ALLOY PROCESS

BACKGROUND OF THE INVENTION

This invention relates to the art of powder metallurgy and, more particularly, it relates to dispersion-strengthened and precipitation-strengthened metals. This invention is the result of a contract with the Department of Energy (Contract No. W-7405-ENG-36).

Alloys of tungsten in uranium are conventionally produced by coreducing $UF_4$ with tungsten oxide or tungsten fluoride. The maximum amount of tungsten which can be alloyed with uranium to obtain a coherent shape using this coreducing process is about 4 wt %. Attempts to use larger amounts of tungsten result in production of a powder. It is believed that, prior to the present invention, no one has made coherent uranium alloys containing more than about 4 wt % tungsten in any significant or substantial quantity.

An alloy of this invention may be described as both a dispersion-strengthened and precipitation-strengthened metal. The strength of the inventive alloys is also increased by solid solution strengthening resulting from the tungsten dissolved in the uranium. Certain metals may be strengthened by adding to them relatively small quantities of particular materials in such a manner that the added materials do not substantially mix with the metal to form a homogenous phase, but are uniformly dispersed in particulate form throughout the metal. The material which is added may be referred to as a dispersoid, while the metal in which it is dispersed is referred to as the matrix metal; the combination is known as a dispersion-strengthened metal or a precipitation-strengthened metal.

A precipitation-strengthened metal is an alloy comprised of a matrix metal throughout which a dispersoid metal has been caused to be distributed by means of cooling a mixture of the dispersoid dissolved in the matrix such that particles of the dispersoid precipitate out. A dispersion-strengthened alloy is a matrix metal having a dispersoid metal distributed throughout it where the dispersoid has been caused to be distributed by means other than precipitation from the matrix metal upon cooling.

Oxides are the most common dispersoids because of their high hardness, stability at high temperature, insolubility in matrix metals, and availability in fine particulate form. However, in the present invention, the dispersoid is tungsten.

Additional information may be found in "Dispersion-Strengthened Materials," 7Powder Metallurgy, 9th Ed., Metals Handbook, American Society for Metals, 710–727 (1984).

Other major uses will be in applications requiring dense material and high mechanical strength.

SUMMARY OF THE INVENTION

This invention is alloys of uranium and tungsten and a method for making the alloys. The amount of tungsten present in the alloys is from about 4 wt % to about 35 wt %. The alloys are coherent shapes. Tungsten particles are dispersed throughout the uranium and a small amount of tungsten is dissolved in the uranium. The alloys are stronger and stiffer than prior art uranium alloys and have large atomic cross sections.

It is an object of this invention to provide high-strength uranium alloys, where the increase in strength over pure uranium results from the addition of tungsten, and to provide a process for making said alloys.

It is also an object of this invention to provide an alloy having a density and atomic cross-section close to those of uranium but having strength and stiffness greater than uranium.

In a broad embodiment, this invention is a method for making an alloy comprised of uranium and tungsten where the amount of tungsten present in the alloy is from about 4 wt % to about 35 wt %, said method comprising placing tungsten powder and uranium in a container; heating said uranium and tungsten to a temperature which is above the melting point of uranium and below the melting point of tungsten to form a molten mixture containing tungsten powder; holding said molten mixture at said temperature for a sufficiently long time period to effect degassing and homogenization of the mixture; and discharging said molten mixture from said container into a mold.

DETAILED DESCRIPTION OF THE INVENTION

Samples of uranium-tungsten alloys of this invention were prepared in the following manner. Commercially pure tungsten powder having a nominal particle size of 19 microns was obtained from Kennametal of Latrobe, Pa. It was later determined that the powder was atypical, in that iron and nickel content was higher then usual. In addition, the powder contained approximately 10% angular particles. The uranium used in the experimentation was depleted uranium, which is essentially nonradioactive and is 99.98 wt % $U^{238}$ with the balance being $U^{235}$. Tungsten powder and uranium in appropriate proportions were placed in a graphite crucible having a coating of stabilized zirconia to prevent reaction between the metals and the graphite. The dimensions of the crucible are about 8 in. O.D × 12 in. high (20 × 30 cm) with a cavity of about 6 in. I.D. × 10 in. high (15 × 25 cm). The uranium was in the form of chunks of plate having dimensions of about 4 × 4 × ¾ in. (10.16 × 10.16 × 1.9 cm). Induction heating was used to heat the contents of the crucible to about 1350° C. in a vacuum. An optical pyrometer was used to determine temperatures. The melting point of uranium is about 1132° C. and that of tungsten is about 3410° C.

The molten uranium containing tungsten, both in solution and in particulate form, was held at about 1350° C. for about one hour in order to drive out any gas which might be entrapped in the melt and to prevent porosity and cracking in the casting. The holding temperature may range from about 1200 to about 1500° C. or more. Note that temperatures well below the melting point of tungsten may be used or the uranium may be heated to a temperature approaching the melting point of tungsten, whereupon the solubility of tungsten in uranium will be greater. The holding period may be from about 5 minutes to 2 hours or more. During the holding period, convective mixing takes place, resulting in a substantially homogenous mixture of uranium and tungsten. After the holding period, a plug at the bottom of the crucible was removed and the contents of the crucible flowed rapidly into a mold, which was at a temperature of about 750 to 800° C. Solidification of the casting usually occurred in about 10 to 20 seconds after the mold was filled. The mold is about 3 in. O.D. × 12 in. high (7.6 × 30 cm) with a cavity of 1 ¼" I.D. × 10 in. high (3 × 25 cm) and is of the same materials as the crucible (graphite coated with stabilized zirconia).

Samples of the castings were subjected to mechanical testing. Test results are presented in the Table, where the yield strength and modulus of elasticity are shown for alloys containing varying amounts of tungsten alloyed with uranium. The yield strength of a 4 wt % tungsten alloy produced by the prior art coreducing process is about 50,000 psi (344.7 kPa). The amount of tungsten in an alloy expressed in volume percent is very close to the amount expressed in weight percent. For example, 25 vol % tungsten in uranium is equivalent to 25.4 wt % and 5 vol % tungsten is equivalent to 5.1 wt %.

TABLE

| Amount of Tungsten, Volume % | Yield Strength, psi × $10^{-3}$ (kPa × $10^{-3}$) | Modulus of Elasticity, psi × $10^{-6}$ (kPa × $10^{-6}$) |
|---|---|---|
| 0 | 26 (179.2) | 21.1 (145.5) |
| 10 | 85 (586) | Not Available |
| 20 | 101.2 (697.7) | 27.4 (188.9) |
| 25 | 111.4 (768) | 28.3 (195.1) |
| 25 | 108.7 (749.4) | 27.2 (187.5) |
| 25 | 111.3 (767.3) | 29.1 (200.6) |
| 30 | 112.5 (775.6) | 29.4 (202.7) |

The increase in strength can be attributed to three separate mechanisms: solid solution strengthening resulting from tungsten dissolved in the uranium, strengthening due to precipitation of small tungsten particles, and strengthening due to undissolved tungsten particles.

Samples were cut and polished and then examined using both an optical microscope and an electron microscope. Substantially all of the tungsten particles dispersed in a casting could be placed into one of three size groupings: about 19 microns in diameter, which is the nominal size of the tungsten powder originally placed in the crucible, about 3 to 6 microns in diameter, and from about 5 to about 20 nm in diameter. The 19 micron and 3 to 6 micron particles were uniformly dispersed while the 5 to 20 nm particles were less uniformly dispersed. The microstructure was that of a dispersion-strengthened and precipitation-strengthened metal. About 0.1 wt % of a casting is dissolved tungsten (at room temperature). According to the phase diagram, the amount of tungsten dissolved in the molten uranium at 1350° C. is about 1 wt %. However, it is clear that more than 1 wt % tungsten was dissolved in the molten uranium; This can be seen by inspection of the sample.

It was originally thought that the processing temperature of 1350° C., coupled with the low solubility of tungsten in uranium, would result in very little dissolution of the tungsten particles. However, metallographic examination of the cast structure revealed the presence of much finer tungsten particles than in the starting powder, with these smaller particles sometimes bonded to the partially dissolved larger particles of the original powder. Additionally, no angular particles were evident. A considerable amount of tungsten went into solution, and the new surfaces of the partially dissolved tungsten particles are providing nucleation sites for growth of the finer particles. The higher-than-anticipated dissolution of the tungsten particles could result from iron and nickel impurities in the tungsten powder. Both iron and nickel dissolve considerable amounts of tungsten and are very soluble in uranium; the solubility of tungsten is increased when these elements are present. Additionally, the lack of angular particles after casting suggests that the high surface energy of the sharp corners on these particles promoted their dissolution.

In the practice of the invention, tungsten powder may be added to uranium after the uranium has been melted. Also, it may be desirable in some applications to mix molten uranium with tungsten powder after the uranium is discharged from the crucible in which it is melted but before the mold is filled. Mixing may be accomplished in a mixing vessel, a chute carrying the substances, or the tungsten powder may be added to a stream of uranium by means of a conduit having its discharge end in the uranium stream.

Samples containing tungsten up to 30 vol % in uranium were made. At that composition, the molten metal containing tungsten powder was quite viscous and flowed very slowly out of the outlet of the crucible.

Tungsten powder having a diameter of 19 microns as determined by a Fisher Sub-sieve Sizer was used in the experimentation because it was readily available through normal commercial channels. It is expected that powder varying in size from the minimum readily obtainable (about 0.5 micron) to about 100 microns may be used in the present invention.

Coherent shape refers to an object and is used to distinguish an object from a powder.

The foregoing description of the invention has been presented for purposes of illustration and description. It is not intended to be exhaustive or to limit the invention to the precise form disclosed. It is intended that the scope of the invention be defined by the claims appended hereto.

What is claimed is:

1. A method for making an alloy having a coherent shape which is comprised of uranium and tungsten where the amount of tungsten present in the alloy is from about 4 wt % to about 35 wt %, said method comprising:

a. placing tungsten powder and uranium in a container;

b. heating said uranium and tungsten to a temperature which is above the melting point of uranium and below the melting point of tungsten to form a molten mixture containing tungsten powder;

c. holding said molten mixture at said temperature for a sufficiently long time period to effect degassing and homogenization of the mixture; and d. discharging said molten mixture from said container into a mold.

2. The method of claim 1 where said molten mixture is held at a temperature of from about 1200° to about 1500° C.

3. The method of claim 1 where said molten mixture is held at a temperature of 1350° C.

4. The method of claim 1 where said holding period is from about 5 minutes to about 2 hours in duration.

5. The method of claim 1 where said holding period is 1 hour in duration.

6. A method for making an alloy having a coherent shape which is comprised of uranium and tungsten where the amount of tungsten present in the alloy is from about 4 wt % to about 35 wt %, said method comprising:

a. placing uranium in a container and heating said uranium to a temperature which is above the melting point of uranium and below the melting point of tungsten to form molten uranium;

b. adding tungsten powder to said molten uranium;

c. holding said molten mixture at said temperature for a sufficiently long time period to effect degassing and homogenization of the mixture; and d. discharging said molten mixture from said container into a mold.

7. The method of claim 6 where said molten mixture is held at a temperature of from about 1200° to about 1500° C.

8. The method of claim 6 where said molten mixture is held at a temperature of 1350° C.

9. The method of claim 6 where said holding period is from about 5 minutes to about 2 hours in duration.

10. The method of claim 6 where said holding period is 1 hour in duration.

11. A method for making an alloy having a coherent shape which is comprised of uranium and tungsten where the amount of tungsten present in the alloy is from about 4 wt % to about 35 wt %, said method comprising:

a. placing uranium in a container and heating said uranium to a temperature which is above the melting point of uranium and below the melting point of tungsten to form molten uranium;

b. holding said molten uranium at said temperature for a sufficiently long time period to effect degassing;

c. discharging said molten uranium from said container; and d. mixing tungsten powder with said molten uranium and discharging the resultant mixture into a mold.

12. The method of claim 11 where said molten mixture is held at a temperature of from about 1200° to about 1500° C.

13. The method of claim 11 where said molten mixture is held at a temperature of 1350° C.

14. The method of claim 11 where said holding period is from about 5 minutes to about 2 hours in duration.

15. The method of claim 11 where said holding period is 1 hour in duration.

* * * * *